US010662816B2

(12) United States Patent
Aguilar et al.

(10) Patent No.: US 10,662,816 B2
(45) Date of Patent: May 26, 2020

(54) SYSTEM AND METHOD TO MOVE TURBOMACHINERY

(71) Applicant: General Electric Company, Schenectady, NY (US)

(72) Inventors: Artemio Josue Aguilar, Queretaro (MX); Juan Carlos Oidor, Queretaro (MX)

(73) Assignee: General Electric Company, Schenectady, NY (US)

( * ) Notice: Subject to any disclaimer, the term of this patent is extended or adjusted under 35 U.S.C. 154(b) by 1027 days.

(21) Appl. No.: 15/097,163

(22) Filed: Apr. 12, 2016

(65) Prior Publication Data

US 2017/0292409 A1 Oct. 12, 2017

(51) Int. Cl.
*F01D 25/28* (2006.01)

(52) U.S. Cl.
CPC ..... *F01D 25/28* (2013.01); *F01D 25/285* (2013.01); *F05D 2240/90* (2013.01); *F05D 2260/02* (2013.01)

(58) Field of Classification Search
CPC ..... F01D 25/28; F01D 25/285; B23P 6/002; F02C 7/20
USPC ..... 60/796–798
See application file for complete search history.

(56) References Cited

U.S. PATENT DOCUMENTS 2,944,766 A * 7/1960 Varhanik ..... B64F 5/50 244/53 B
6,279,309 B1 8/2001 Lawlor et al.
6,349,793 B1 2/2002 Kincaid
6,772,997 B2 8/2004 Keaton et al.
7,014,012 B2 3/2006 Baker
7,284,744 B1 10/2007 Lerchenmueller et al.
7,976,266 B2 * 7/2011 Brown ..... F02C 7/20 248/157
8,523,146 B2 9/2013 Polins et al.
8,590,151 B2 * 11/2013 Brown ..... F01D 25/285 184/1.5
8,621,873 B2 1/2014 Robertson et al.
(Continued)

FOREIGN PATENT DOCUMENTS

DE 19741692 A1 4/1999
EP 1426275 A1 6/2004
(Continued)

OTHER PUBLICATIONS

U.S. Appl. No. 14/875,969, filed Oct. 6, 2015, Artemio Josue Aguilar.

*Primary Examiner* — Justin D Seabe
*Assistant Examiner* — Cameron A Corday
(74) *Attorney, Agent, or Firm* — Fletcher Yoder, P.C.

(57) ABSTRACT

A system includes a turbine housing, a turbine mount disposed in the turbine housing, and a turbine moving machine disposed at least partially within the turbine housing. The turbine moving machine includes a turbine support configured to couple to a turbine and a first translational portion coupled to the turbine support. The turbine moving machine is configured to move the turbine lengthwise along the first translational portion between a first turbine position within the turbine housing and a second turbine position outside of the turbine housing. The turbine moving machine includes a vertical adjustment assembly configured to raise and lower the turbine.

22 Claims, 8 Drawing Sheets

(56) References Cited

U.S. PATENT DOCUMENTS

| | | | | |
|---|---|---|---|---|
| 8,672,606 | B2 * | 3/2014 | Glynn | F01D 25/28 184/1.5 |
| 8,677,589 | B2 | 3/2014 | Ziekow et al. | |
| 8,844,297 | B2 | 9/2014 | Arase et al. | |
| 9,004,103 | B2 | 4/2015 | Foo et al. | |
| 9,028,196 | B2 | 5/2015 | McConnell | |
| 2004/0037687 | A1 | 2/2004 | Weiss | |
| 2007/0034125 | A1 | 2/2007 | Lo | |
| 2008/0011932 | A1 * | 1/2008 | Stretton | B66C 1/10 248/544 |
| 2011/0099788 | A1 | 5/2011 | Kilibarda | |
| 2012/0110816 | A1 * | 5/2012 | Groves | B62B 3/10 29/428 |
| 2016/0263715 | A1 * | 9/2016 | Gerber | B23P 19/042 |
| 2017/0234165 | A1 * | 8/2017 | Kersey | F16M 9/00 60/798 |

FOREIGN PATENT DOCUMENTS

| | | | | |
|---|---|---|---|---|
| WO | 2013174935 | A1 | 11/2013 | |
| WO | WO-2017213848 | A1 * | 12/2017 | F02C 7/20 |

* cited by examiner

SYSTEM AND METHOD TO MOVE TURBOMACHINERY

BACKGROUND

The subject matter disclosed herein relates to equipment to move loads, such as heavy machinery.

A variety of industrial and commercial applications may use heavy machinery, such as generators and turbomachinery (e.g., turbines, compressors, and pump). The heavy machinery may be moved for many reasons, such as initial installation, servicing, or replacement. Unfortunately, the heavy machinery may be installed in locations that are difficult to access. As a result, the heavy machinery may be difficult to move.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine housing, a turbine mount disposed in the turbine housing, and a turbine moving machine disposed at least partially within the turbine housing. The turbine moving machine includes a turbine support configured to couple to a turbine and a first translational portion coupled to the turbine support. The turbine moving machine is configured to move the turbine lengthwise along the first translational portion between a first turbine position within the turbine housing and a second turbine position outside of the turbine housing. The turbine moving machine includes a vertical adjustment assembly configured to raise and lower the turbine.

In a second embodiment, a system includes a turbine housing comprising opposite walls, a floor, and a ceiling extending lengthwise along a longitudinal axis, a first end wall, and a second end wall opposite the first end wall. The first end wall comprises an access panel configured to selectively open an access opening. The system includes a turbine mount disposed in the turbine housing and a ground rail assembly. The system includes an auxiliary skid configured to support one or more turbine support components. The auxiliary skid is configured to move along the ground rail assembly between a first skid position adjacent the first end wall and a second position at an offset distance away from the first end wall.

In a third embodiment, a method includes supporting a turbine with a turbine support of a turbine moving machine disposed at least partially within a turbine housing. The method includes moving the turbine lengthwise along a first translational portion of the turbine moving machine between a first turbine position within the turbine housing and a second turbine position outside of the turbine housing.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
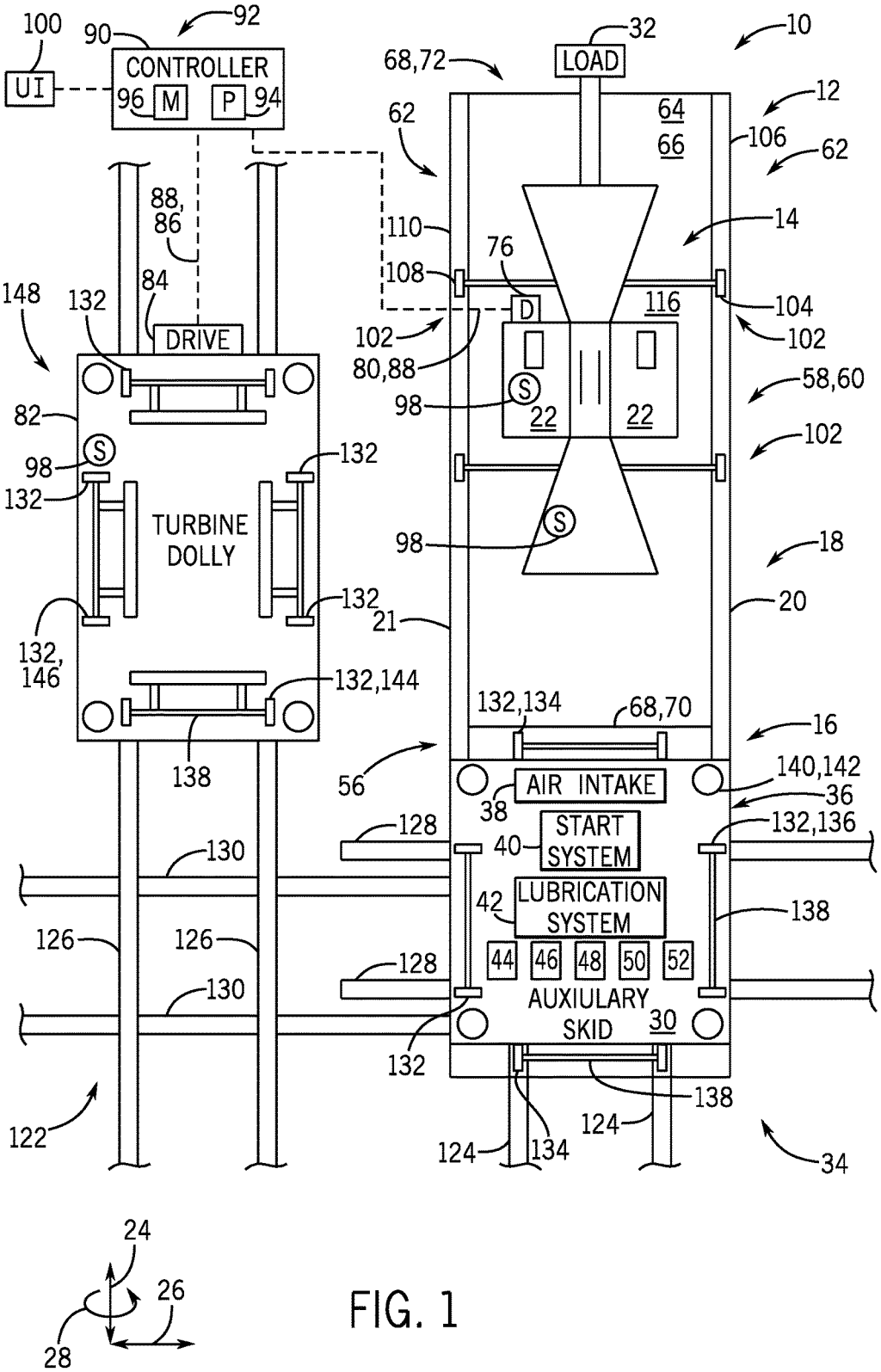
FIG. 1 is a schematic view of an embodiment of a turbine moving machine configured to move a turbine from a turbine housing, wherein the turbine moving machine moves lengthwise along a first translational portion coupled to a turbine support.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments are directed toward a load moving system including a turbine moving machine that facilitates movement of the turbine from an axial end of a turbine housing, where the turbine is coupled to a turbine support and is moved lengthwise along a first translational portion. After the turbine is removed from the turbine housing, the turbine may be moved out of and away from the turbine housing along a ground rail assembly. Utilizing the ground rail assembly may provide a path for the turbine to be readily moved from a first position to a second position so that the turbine may be accessed for another purpose at the second position, such as for repairs, maintenance, servicing, replacement, and so forth. The embodiments of the turbine moving system may be particularly useful when moving a turbine or other machinery may be affected by conditions affecting the stability of the turbine. For example, the turbine moving system may be beneficial during conditions such as heavy wind conditions, areas with limited space, regulatory requirements (e.g., class areas), movement in the pitch, yaw, and/or roll motions (e.g., on a ship deck or other vessel on a body of water), or other conditions affecting the stability of the turbine or machinery to be moved.

The turbine moving machine may include a turbine mount (e.g., a floor of the turbine housing) and a turbine support configured to couple to the turbine. The turbine may be moved along a first translational portion (e.g., mating rails and/or wheels disposed within the turbine housing), while remaining coupled to the turbine support. The turbine support may remain coupled to the turbine when the turbine is disposed within the housing and when the turbine is moved to the dolly. The turbine support may include a jungle gym (e.g., a cage), a turbine support frame, a spreader bar, one or more lift supports, a brace, a guide, or other components used to support the turbine.

The first translational portion may include mating rails and/or wheels that enable the turbine to be translated along a longitudinal access of the turbine housing from a first position to a second position. In one example, the first position may be disposed within the turbine housing, and the second position may be disposed outside the turbine housing (e.g., when the turbine removed from the housing). Accordingly, the turbine moving machine may be disposed partially within the turbine housing when the turbine is in the first position. The turbine housing may include more than one pair of rails. For example, the turbine housing may include one pair of rails disposed towards the top of the turbine housing adjacent a ceiling of the turbine housing (e.g., overhead a turbine area for the turbine), and another pair of rails disposed adjacent the floor of the turbine housing (e.g., below the turbine area for the turbine). Additionally, other pairs of rails may be disposed within the turbine housing to facilitate movement of the turbine.

As described in detail below, the turbine housing may include an access panel disposed at either or both axial ends (e.g., the front end, a rear end, or a first end wall) of the turbine housing so that the turbine or other machinery may be removed from the turbine housing through the axial end. The access panel may include a door configured to swing outward in a direction away from the axial end of the turbine housing (e.g., a first end wall) to open outwardly. The access panel may be coupled to the axial end through a rotational joint, hinge, swivel, or other suitable rotating couplings. As described above, the turbine housing includes a pair of opposite walls (e.g. to support the rails), the floor, and the turbine housing ceiling extending lengthwise along a longitudinal axis of the turbine housing. The turbine housing may also include end walls (e.g., a first end wall and a second end wall) disposed opposite of each other. Though the description above pertains to a turbine housing, it should be appreciated that the embodiments described herein may be applicable to other load driving machinery.

The turbine is translated in a first direction (e.g., along a longitudinal axis of the turbine housing) and uses a first translational portion (e.g., a pair of rails coupled to the turbine housing) and wheels. In some embodiments, the turbine may be moved using more than one translational portions (e.g., a first and a second translational portion). The translational portions include a rail segment disposed within the turbine housing, and a mating rail segment. The rail segment and the mating rail segments are aligned when the turbine is moved by the turbine moving machine to facilitate movement of the turbine out of the turbine housing and onto the dolly. The turbine dolly may be moved along a set of ground rails to a position in front of the turbine housing (e.g., at the first end wall) to receive the turbine. The turbine dolly may be locked into position in front of the turbine housing to receive the turbine. As described in detail below, the turbine dolly may include a plurality of wheels (e.g., a first plurality of wheels, a second plurality of wheels). Each of the pluralities of wheels are disposed along a rotating shaft and may be configured to move when the wheels are utilized. For example, a first plurality of wheels may be utilized to move the turbine dolly in the direction of the longitudinal axis of the turbine housing. When the first plurality of wheels is being utilized to move the turbine dolly in the longitudinal direction, the second plurality of wheels is disengaged. When the turbine dolly is moved in a second direction crosswise (e.g., substantially perpendicular) to the first longitudinal direction (e.g., via a second pair of dolly rails of the ground rail assembly), the first plurality of wheels is disengaged. The first plurality of wheels are disengaged when the second plurality of wheels are being utilized (e.g., when the rotating shaft disposed between the second plurality of wheels rotates in a downward direction to position the second plurality of wheels on the second pair of dolly rails).

Once the turbine has been moved to the dolly, the turbine may be moved along a ground rail assembly. The ground rail assembly may include at least a first pair of ground rails and a second pair of ground rails. The first pair and the second pair of ground rails may be oriented in various ways to support the movement of the turbine. In one embodiment, the first pair and the second pair of ground rails may be substantially perpendicular to each other. Once the turbine is moved away from the turbine housing, the turbine may be serviced, repaired, replaced, or otherwise maintained. The turbine may then be removed from the ground rail assembly all together (e.g., via a crane) or the turbine may re-installed for further use within the turbine housing.

Turning now to the drawings, FIG. 1 is a schematic view of a turbine moving system 10 including a turbine moving machine 12 configured to move a turbine 14 from a front end 16 of a turbine housing 18, where the turbine moving machine 12 moves lengthwise along first and second translational portions 20 and 21 coupled to a turbine support 22.

The turbine 14 may include a gas turbine engine, a steam turbine, a hydro turbine, or any combination thereof. The gas turbine may include a compressor section, a combustor section, and a turbine section. For purposes of this discussion, reference may be made to a first vertical direction 24 (e.g., longitudinal axis 24 of the turbine housing 18), a second horizontal direction 26 crosswise to the first vertical direction 24 (e.g., substantially perpendicular), and the rotational or circumferential direction 28 disposed about the first vertical direction. As used herein, the terms horizontal and vertical may include some degree of deviation from the horizontal and vertical (e.g., 5, 10, 15, 20, 25, or 30 degrees) from the horizontal and vertical directions. The terms horizontal and vertical may be used for convenience to indicate that the axes, directions, and/or planes are generally crosswise (e.g., substantially perpendicular) to one another. The turbine moving machine 12 is configured to move the turbine 14, in a controlled and stabilized manner, in the first direction 24 along the longitudinal axis and in the second direction 26 along a horizontal axis.

The turbine moving machine 12 may be used to move other heavy equipment, such as a compressor, a pump, an electric generator, a reciprocating internal combustion engine, other heavy machinery, or a combination thereof. The load moving machine 12 may be used in a variety of applications, such as in a vessel at sea, an assembly line, an industrial plant, or any other suitable application. The load 32 may include an electric generator, a compressor, or a pump.

Disposed outside the turbine housing 18 may be an auxiliary system (e.g., an auxiliary skid 30). The auxiliary skid 30 may be disposed in a first skid position 34 when the turbine 14 is operating to support the turbine 14 and/or the load 32. The auxiliary skid 30 may include one or more support components 36, such as an air intake system 38, a start up system 40, a lubrication system 42, an oil system 44, a coolant system 46, a fuel system 48, a fluid injection system 50, a thermal/clearance control system 52, and so forth. In some embodiments, there may be one or more of the same support components 36 in the auxiliary skid 30. For example, the turbine 14 may include one or more lubrication systems 42 to lubricate moving parts of the engine and/or a generator. When the turbine 14 needs to be removed from the turbine housing 18 (e.g., for maintenance), the auxiliary skid 30 may be moved to a second skid position 54 (see FIGS. 2-3) so that an access panel 56 of the turbine housing 18 can be opened and the turbine 14 removed, as described in detail below.

The turbine moving system 12 may have a frame (e.g., turbine housing 18) to support the translational portions 58 (e.g., the turbine housing rails 60). The turbine housing 18 includes a pair of opposite walls 62, the floor 64, and the turbine housing ceiling 66 extending lengthwise 24 along the longitudinal axis of the turbine housing 18. The turbine housing 18 may also include end walls 68 (e.g., a first end wall 70 and a second end wall 72) disposed opposite of each other. The turbine housing floor 64 may include a plurality of structural supports extending in directions 74 to define a framework for the turbine 14 to be supported on within the turbine housing 18. The turbine support 22 may be coupled to the turbine 14 to provide a framework around the turbine 14 so that the turbine 14 may be translated along the turbine housing rails 60 along the length of the turbine housing 18. The turbine support 22 may move the turbine 14 in various directions 24, 26 within and beyond the perimeter of the turbine housing 18. The turbine moving system 12 may include a drive system 76 coupled to the turbine support 22, where the drive system 76 includes a plurality of drives 78 and transmissions 80 configured to drive the movement of the turbine 14 in the various directions 24, 26. A turbine dolly 82 may also include a dolly drive system 84 including a drive 86 and a transmission 88 configured to drive the movement of the dolly 82 in various directions 24, 26.

The drives of the drive systems 76, 84 may include an electric drive (e.g., an electric motor), a fluid drive (e.g., a liquid or hydraulic drive and/or a gas or pneumatic drive), or a combination thereof. The fluid drive may include a piston driven assembly having a piston disposed in a cylinder. The transmissions 80, 88 may include a translational or rotational shaft, a gear box or gear assembly, a telescopic assembly having a plurality of concentric sleeves or shafts that extend and retract relative to one another, a cable and pulley system having a winch, a worm gear assembly, a rack and pinion gear assembly, or any combination thereof. The drive systems 76, 84 may include an independent drive and transmission for movement in each of the directions 24, 26, 28, or the drive system may share drives and/or transmissions for movement in two or more of the directions 24, 26, 28. The drive systems 76 configured to drive the movement of the turbine support 22 may be disposed along the first translational portion 20, the second translational portion 21, in a position between the first and second translational portion 20, 21, or any combination thereof. As discussed in detail below with reference to FIGS. 10-13, the transmissions may include a variety of mechanisms to move the turbine support 22 or the dolly 82 in response to the drive.

The drive systems 76, 84 may be coupled to a control system 90, which may include one or more controllers 92 (e.g., electronic controllers) having a processor 94 and memory 96 (e.g., random access memory, read only memory, flash memory, volatile or non-volatile memory, hard drive, etc.). The controllers 92 are configured to store instructions in the memory 96 and execute the instructions via the processor 94 to control operation of the drive systems 76, 84. In particular, the controllers 92 may execute instructions to control the drives to balance the turbine 14 and to provide a stable rate of movement in the directions 24, 26 based on a size, weight, shape, or other characteristics of the load, the stability of the locations (e.g., mounted on a ship), and so forth. For example, the controllers 92 may be configured to control the movement of the turbine 14 via the turbine moving machine 12, including the turbine support 22. The control system 90 may communicatively couple to various sensors 98 throughout the turbine moving system 12 and use sensor feedback to help improve the movement of the turbine 14. The sensors 98 may include speed sensors, accelerometers, wind sensors, vibration sensors, force or resistance sensors, load level sensors, load tilt or angle sensors, load weight sensors, location stability sensors (e.g., motion caused by waves), or any combination thereof. The control system 90 also may include a user interface 100 or control panel having a display (e.g., LED, LCD, or touch screen display), user inputs (e.g., buttons, keypad or keyboard, touchpad, mouse, etc.), outputs or alerts (e.g., audio or visual alarms), or any combination thereof.

As described in detail below, the turbine support 22 may be coupled to the first translational portion 20 and the second translational portion 21 (e.g., housing rails and wheels) disposed along the pair of opposite walls 62 within the turbine housing 18. The first translational portion 20 and the second translational portion 21 may include wheels 102, as described in detail with reference to FIGS. 6-7. As described below in further detail, the first translational portion 20 comprises one or more first wheels 104 disposed along a first rail portion 106 of the first translational portion 20 and the turbine support 22. Similarly, the second translational portion 21 comprises one or more second wheels 108 disposed along a second rail portion 110 of the second translational portion 21 and the turbine support 22. The first translational portion 20 and the second translational portion 21 include a first and a second rail segment 106, 110 disposed within the turbine housing 18, and a first and a second mating rail segments 112, 114 (see FIG. 3) that may extend outside the perimeter of the turbine housing 18. The rail segments 106, 110 and the mating rail segments 112, 114 are aligned when the turbine 14 is moved by the turbine moving machine 12 (e.g., the turbine support 22) to facilitate movement of the turbine 14 out of the turbine housing 18 and onto the dolly 82. When the turbine 14 is positioned within the turbine housing 18, the turbine 14 may be said to be at the first position 116. When the turbine 14 needs to be accessed and removed outside of the turbine housing 18 (e.g., for access, repair, maintenance), the turbine support 22 translates the turbine 14 along the first and second translational portions 20, 21 to a second turbine position 118 outside the perimeter of the turbine housing 18 (see FIG. 4). The turbine housing 18 includes the access panel 56 disposed along the first end wall 70. The access panel 56 may be opened outwardly by rotating the access panel along a rotational support 120 in a direction away from the second end wall 72 (see FIG. 2). Before the access panel 56 is opened, the auxiliary skid 30 may be moved in the second direction 26 (e.g., substantially perpendicular to the longitudinal axis of the turbine housing 18) from the first skid position 34 located adjacent the first end wall 70 of the turbine housing 18 to the second skid position 54. The second skid position 54 may vary based on the space available. The auxiliary skid 30 may be moved to the second skid position 54 via a ground rail assembly 122.

In the illustrated embodiment, the ground rail assembly 122 includes a first pair of turbine ground rails 124 (e.g., disposed below the turbine housing 18) and a first pair of dolly ground rails 126 (e.g., disposed substantially parallel to the turbine housing 18). It may be appreciated that the turbine dolly 82 may move on the first pair of turbine ground rails 124 and the first pair of dolly ground rails 126. In some embodiments, the ground rail assembly 122 may have universal rails for the turbine dolly 82, the auxiliary skid 30, and so forth. The ground rail assembly 122 also includes a pair of auxiliary ground rails 128 (e.g., disposed substantially perpendicular to the first pair of turbine ground rails) and a second pair of dolly rails 130 (e.g., disposed substantially perpendicular to the first pair of dolly ground rails). In certain embodiments, the first pair of dolly ground rails 126 may be independent and separate from the pair of ground auxiliary ground rails 128. In the illustrated embodiment, the first pair of dolly ground rails 126 and the pair of ground auxiliary ground rails 128 are dependent on one another in a partially nested arrangement.

The auxiliary skid 30 and the turbine dolly 82 both comprise sets of wheels 132 to facilitate movement in directions 24, 26 along the ground rail assembly. For example, the auxiliary skid 30 comprises a first plurality of wheels 134 and a second plurality of wheels 136. The first plurality of wheels 134 is configured to selectively engage the first pair of ground rails 124 (e.g., first pair of turbine ground rails) when a rotating shaft 138 disposed between the first plurality of wheels 134 rotates in a downward direction to position the first plurality of wheels 134 on the first pair of ground rails 124. When the first plurality of wheels 134 is selectively engaged with the first pair of ground rails 124, the auxiliary skid 30 may be moved in the direction 24 along the longitudinal axis to move the auxiliary skid 30 closer to or further from the turbine housing 18. When the first plurality of wheels 134 are not engaged with the first pair of ground rails 124, the rotating shaft 138 disposed between the first plurality of wheels 134 rotates, pivots, or lifts in an upwards direction so that the first plurality of wheels 134 are not in contact with the rails 124 (e.g., first pair of ground rails). The second plurality of wheels 136 may then be selectively engaged with the pair of auxiliary ground rails 128. When the second plurality of wheels 136 is engaged with the pair of auxiliary ground rails 128, the auxiliary skid 30 may be moved from the first skid position 34 to the second skid position 54. The auxiliary skid 30 includes a plurality of support feet 140 configured to extend from a bottom surface of the auxiliary skid 30 to the ground when the auxiliary skid 30 is in its first skid position 34 to secure the auxiliary skid 30 in its first skid position 34 (e.g., via locking assemblies 142). The support feet 140 may be raised and lowered with the vertical adjustment assembly and/or a manual actuator. The locking assemblies 142 may be disengaged when the auxiliary skid 30 needs to be moved from the first skid position 34 to the second skid position 54 to enable movement of the auxiliary skid 30 along the ground rail assembly 122. Once the auxiliary skid 30 is in its second skid position 54, the control system 90 may selectively actuate the lock assemblies 142 to lock the auxiliary skid 30 and block movement of the auxiliary skid 30 along the pair of auxiliary ground rails 128.

The movement of the turbine dolly 82 may be facilitated in a similar manner. For example, the turbine dolly 82 may include a plurality of wheel sets 132 (e.g., the first plurality of wheels 144, the second plurality of wheels 146). Each of the plurality of wheels are disposed along a rotating shaft 138 and may be configured to move when the wheel sets are utilized. For example, the first plurality of wheels 144 may be utilized to move the turbine dolly 82 in the direction 24 of the longitudinal axis of the turbine housing 18 along the first pair of dolly ground rails 126. When the first plurality of wheels 144 is being utilized to move the turbine dolly 82 in the longitudinal direction, the second plurality of wheels 146 is disengaged. When the turbine dolly 82 is moved in the second direction 26 that is substantially perpendicular to the first longitudinal direction 24 (e.g., via the second pair of dolly rails 130), the first plurality of wheels 144 is disengaged. The first plurality of wheels 144 are disengaged when the second plurality of wheels 146 are being utilized (e.g., when the rotating shaft 138 disposed between the second plurality of wheels 146 rotates, pivots, or lowers in a downward direction to position the second plurality of wheels 146 on the second pair of dolly rails 130).

Figure 2:
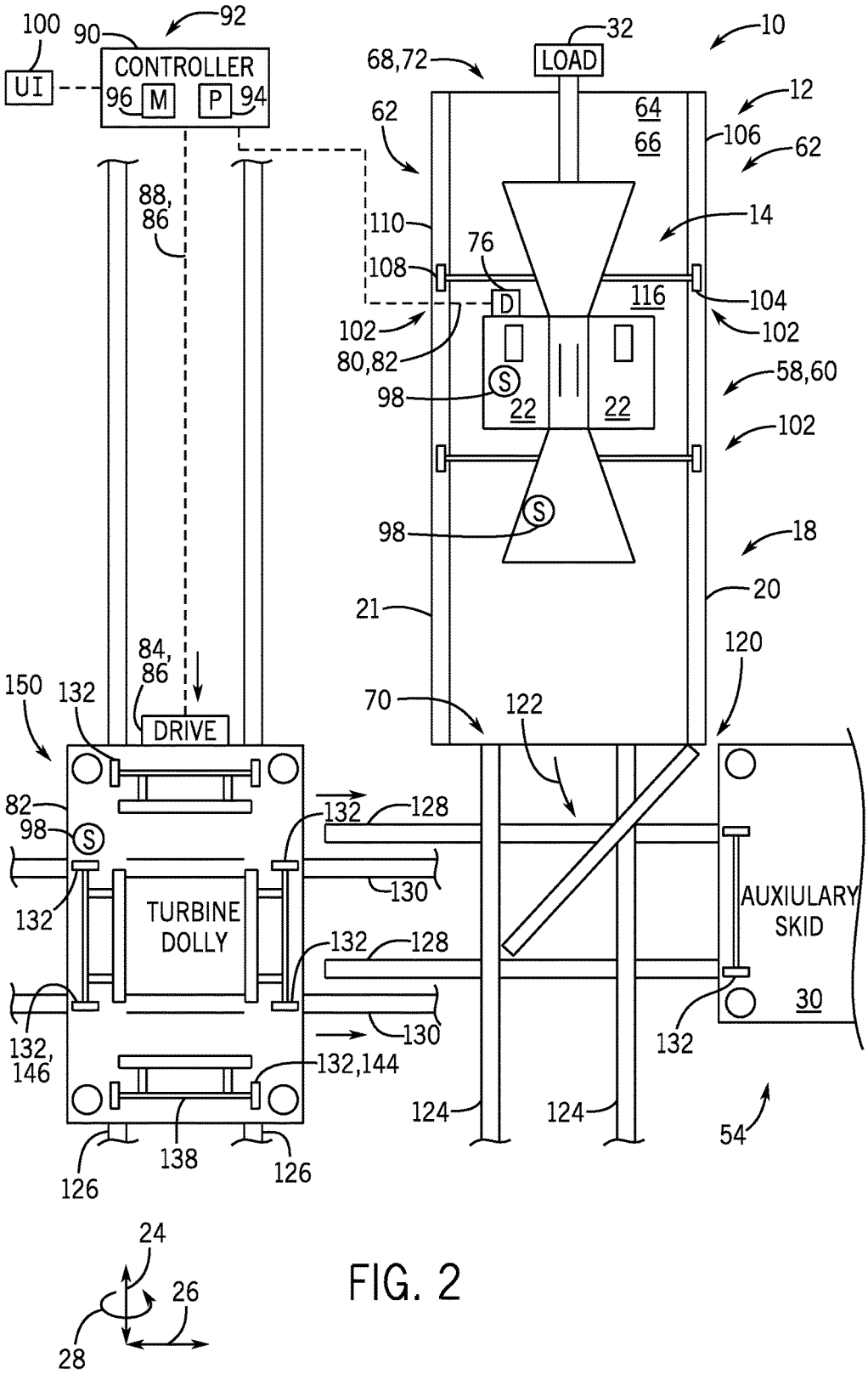
FIG. 2 is a schematic view of an embodiment of the turbine moving machine configured to move the turbine from the turbine housing, wherein an access panel of the turbine housing is partially open to unload the turbine from the turbine housing.

The turbine dolly 82 may be moved from a first dolly position 148 to a second dolly position 150 (see FIG. 2). The dolly 82 may include a plurality of support feet 140 configured to extend from a bottom surface of the turbine dolly 82 to the ground when the turbine dolly 82 is in its first dolly position 148 to secure the turbine dolly 82 in its first dolly position 148 (e.g., via locking assemblies 142). The locking assemblies 142 may be disengaged when the turbine dolly 82 needs to be moved from the first dolly position 148 to the second dolly position 150 to enable movement of the turbine dolly 82 along the ground rail assembly 122. Once the turbine dolly 82 is in its second dolly position 150, the control system 90 may selectively actuate the lock assemblies 142 to lock the turbine 14 and block movement of the turbine 14 along the second pair of dolly ground rails 130. The turbine dolly 82 may later be translated to a third dolly position 152 to receive the turbine 14, as described further with reference to FIG. 3. As described below with reference to FIG. 10, the dolly 82 comprises a vertical adjustment assembly 154 configured to raise and lower the turbine 14. The vertical adjustment assembly 154 helps to align the mating rail segments 112, 114 with the first and second rail segments 106, 110.

Turning now to FIGS. 2-5, the movement of the turbine 14, the turbine support 22, the auxiliary skid 30, and the turbine dolly 82 may be better understood. FIG. 2 is a schematic view of the turbine moving machine 12 configured to move the turbine 14 from the turbine housing 18, wherein the access panel 56 of the turbine housing 18 is partially open to unload the turbine 14 from the turbine housing 18. Prior to opening the access panel 56, the auxiliary skid 30 is moved to expose the access panel 56. As shown, the access panel 56 may be opened via the rotational joint 120 (e.g., hinge). The rotational joint 120 enables the access panel 56 to be rotated outwards from the turbine housing 18. It may appreciated that when the access panel 56 is in the closed position, an access opening 160 disposed within the access panel 56 may be utilized to access the turbine 14. The access opening 160 may be circular, elliptical, square, rectangular, or any other suitable polygonal shape to enable access to the turbine 14. Accessing the turbine 14 via the access opening 160 may enable the turbine 14 to be serviced in place, repaired, viewed, or accessed for other reasons while remaining in the turbine housing 18. As described above, the auxiliary skid 30 may be locked into place via the plurality of support feet 140 configured to extend from a bottom surface of the auxiliary skid 30 to the ground when the auxiliary skid 30 is in its first skid position 34 to secure the auxiliary skid 30 in its first skid position 34 (e.g., via locking assemblies 142). Before the access panel 56 is opened, the locking assemblies 142 coupled to the support feet 140 may be uncoupled and the auxiliary skid 30 may be moved in the direction 26 perpendicular to the longitudinal axis along the pair of auxiliary ground rails 128 from the first skid position 34 to the second skid position 54 so that the access panel 56 may be opened more easily.

Once the access panel 56 is opened, the turbine dolly 82 may be translated in the direction 24 along the first pair of dolly ground rails 126 using the first plurality of wheels 144 from the first dolly position 148. Once the turbine dolly 82 is aligned with the second pair of dolly rails 130 (e.g., near the second dolly position 150), the first plurality of wheels 144 is disengaged. The first plurality of wheels 144 are disengaged when the second plurality of wheels 146 are being utilized (e.g., when the rotating shaft 138 disposed between the second plurality of wheels 146 rotates, pivots, or lowers in a downward direction to position the second plurality of wheels 146 on the second pair of dolly rails 130). Once the turbine dolly 82 is in the second dolly position 150, the second plurality of wheels 146 may be engaged. The second plurality of wheels 146 may be used to translate the turbine dolly 82 along the second pair of dolly rails 130 to reach a third dolly position 152 as discussed further with reference to FIG. 3.

Figure 3:
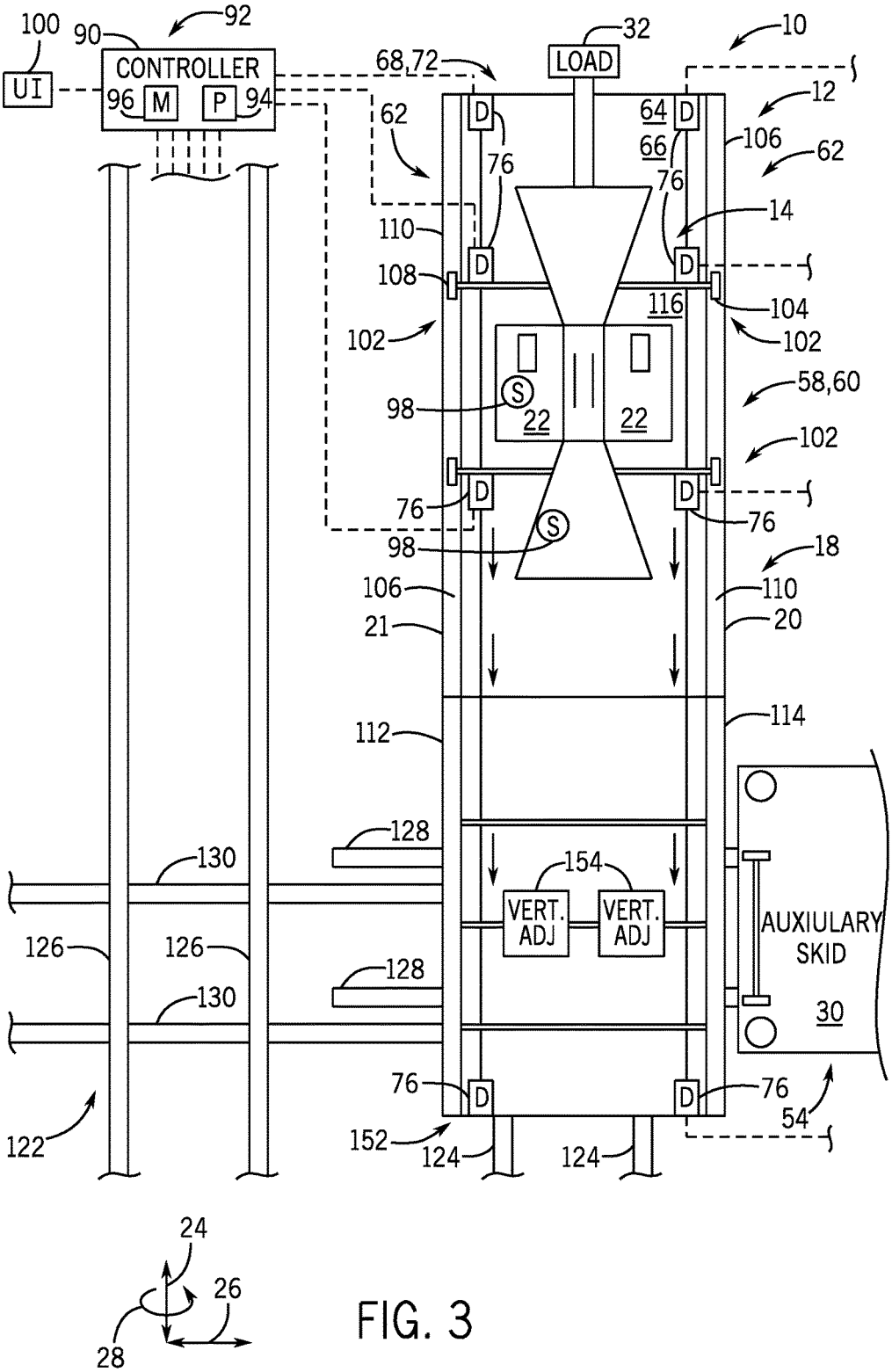
FIG. 3 is a schematic view of an embodiment of the turbine moving machine, wherein a dolly configured to receive the turbine is aligned with the turbine moving machine to receive the turbine from the front of the turbine moving machine, and the access panel is completely open.

FIG. 3 is a schematic view of the turbine moving machine 12, wherein a dolly 82 configured to receive the turbine 14 is aligned with the turbine moving machine 12 to receive the turbine 14 from the front of the turbine moving machine 12, wherein the access panel 56 is completely open. As described above, the turbine 14 is translated in the first direction 24 (e.g., along a longitudinal axis of the turbine housing 18) and uses the first and second translational portions 20, 21 (e.g., the first and second rail portions 106, 110 coupled to the turbine housing coupled to the first and second mating rail segments 112, 114) and wheels to move. The translational portions 20, 21 include the rail portions 106, 110 disposed within the turbine housing 18, and the mating rail segments 112, 114. The rail segments 106, 110 and the mating rail segments 112, 114 are aligned when the turbine 14 is moved by the turbine moving machine 12 to facilitate movement of the turbine 14 out of the turbine housing 18 and onto the dolly 82. When the turbine dolly 82 is translated from the second position 150 to the third position 152 (e.g., adjacent the turbine housing 18), the plurality of support feet 140 coupled to the dolly 82 may be engaged. The plurality of support feet 140 may be locked into place (e.g., in the third dolly position 152) via the locking assemblies 142. Once the locking assemblies 142 are engaged, the turbine dolly 82 may be lifted or lowered via a lift mechanism. The turbine dolly 82 may be lifted or lowered vertically by using the vertical adjustment assembly 154.

The vertical adjustment assembly 154 includes a lift portion 162 that is driven by a drive to cause vertical movement of the lift portion 162. The lift portion 162 may be coupled to the turbine dolly 82 via a plurality of couplings, which may include threaded fasteners (e.g., threaded receptacles, bolts, nuts, etc.), clamps, rods, receptacles, welds, or any combination thereof. The lift portion 162 may include a retractable joint 164 (see FIG. 10) that moves in the vertical direction. The retractable joint 164 may be coupled to the lift portion 162 at a first end 166 by welding, brazing, threaded fasteners, a flange with connecting members, or any other suitable process. The vertical adjustment assembly 154 may include a variety of lifting assemblies, such as an electrical chain hoist, an electrical wire rope hoist, a hydraulic winch, or other suitable lifting mechanism to lift and/or lower the lift portion 162. For example, the vertical adjustment assembly 154 may include a hoist or winch system having a spool coupled to the drive and a line coiled around the spool and coupled to assembly 154 at a coupling. The line may include a cable, a chain, a rope, or any combination thereof, made of metal, fabric, plastic, etc. The hoist or winch system also may include one or more pulleys to route the line from the spool to the coupling. The orientation of the vertical adjustment assembly may be further understood with respect to FIG. 10. The turbine dolly 82 is lifted until the turbine dolly 82 is substantially aligned with the turbine housing 18. When the turbine dolly 82 is substantially aligned with the turbine housing 18, the turbine 14 may be translated (e.g., along the longitudinal axis) onto the turbine dolly 82.

Figure 4:
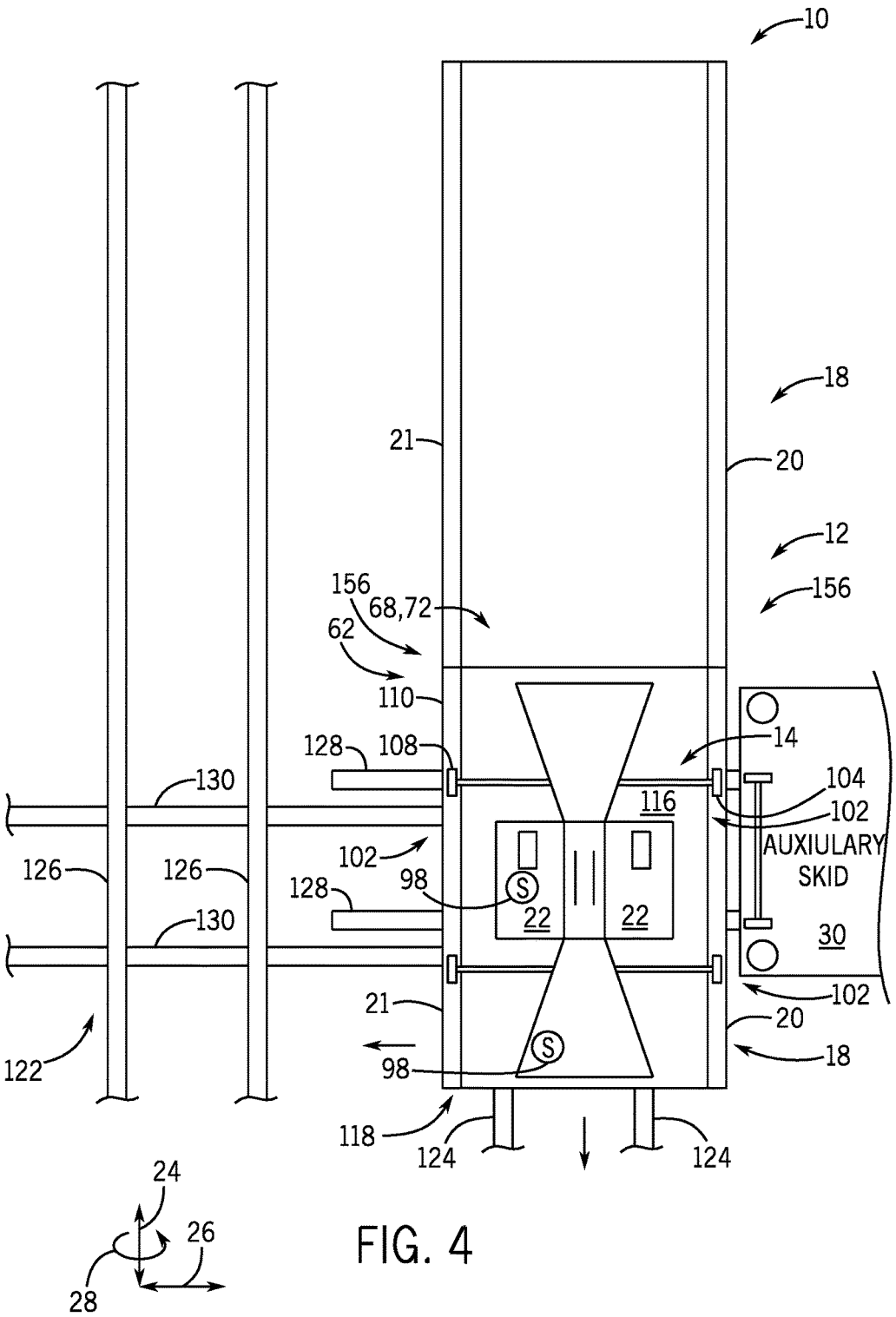
FIG. 4 is a schematic view of an embodiment of the turbine moving machine, wherein the turbine is translated along a first translational portion of the turbine moving machine and is received by the dolly.

FIG. 4 is a schematic view of an embodiment of the turbine moving machine 12, wherein the turbine 14 is translated along the first translational portion 20 and is received by the dolly 82 for movement of the turbine 14 along the ground rail assembly 122. Once the turbine 14 has been moved onto the turbine dolly 82, the turbine 14 and the turbine dolly 82 may be moved away to another location. As explained above, the turbine 14 may be moved to service, repair, inspect, or maintain the turbine 14. Utilizing the turbine dolly 82 may be particularly useful when movement of the turbine 14 may be affected by conditions affecting the stability of the turbine 14. For example, the turbine moving system 12 may be beneficial during conditions such as heavy wind conditions, areas with limited space, regulatory requirements (e.g., class areas), movement in the pitch, yaw, and/or roll motions (e.g., on a ship deck or other vessel on a body of water), or other conditions affecting the stability of the turbine 14 or machinery to be moved. The turbine dolly 82 may be translated along the first pair of turbine ground rails 124 or along the second pair of the dolly rails 130, so that the turbine 14 is moved away from the turbine housing 18.

Figure 5:
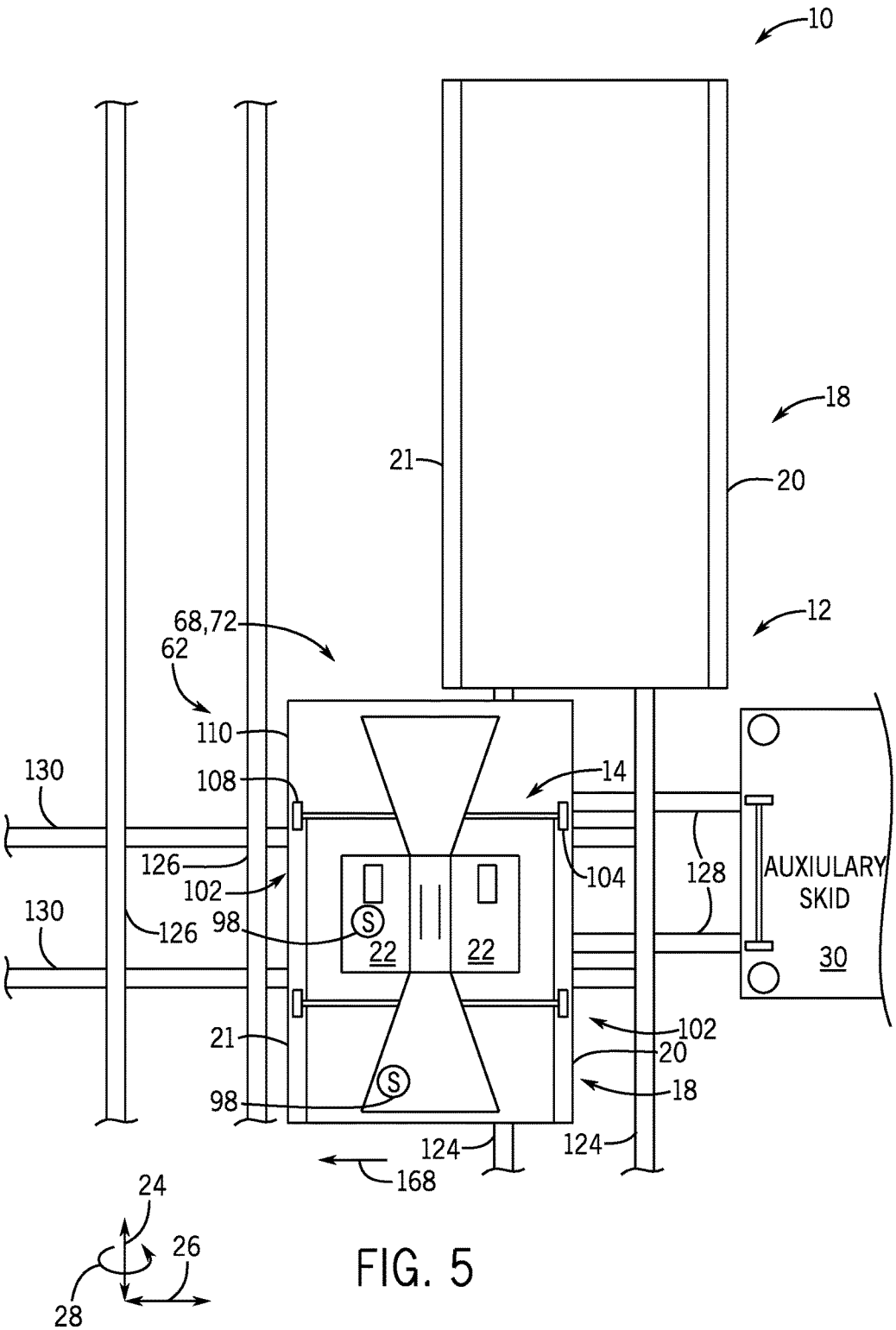
FIG. 5 is a schematic view of an embodiment of the turbine moving machine, wherein the turbine is transported along the ground rail assembly in a direction opposite an auxiliary skid.

FIG. 5 is a schematic view of an embodiment of the turbine moving machine 12, wherein the turbine 14 is transported along the ground rail assembly 122 in a direction opposite the auxiliary skid 30, indicated by arrow 168. When the turbine dolly 82 is moved away from the turbine housing 18 (e.g., via the along the first pair of turbine ground rails 124 or along the second pair of the dolly rails 130), the turbine housing 18 may be accessed. For example, the components of the turbine housing 18 (e.g., the first rail segment 106 and the second rail segment 110, the ceiling 66, supports) may be accessed for repair or inspection. Additionally, the auxiliary skid 30 may be accessed. In some embodiments, another turbine 14 or other turbomachinery may be added into the turbine housing 18 (e.g., via a crane).

Figure 6:
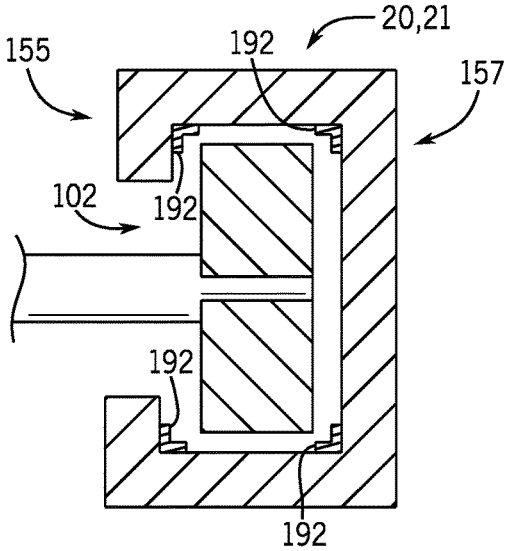
FIG. 6 is a partial schematic view of an embodiment of the first translational portion and/or the second translational portion.
Figure 7:
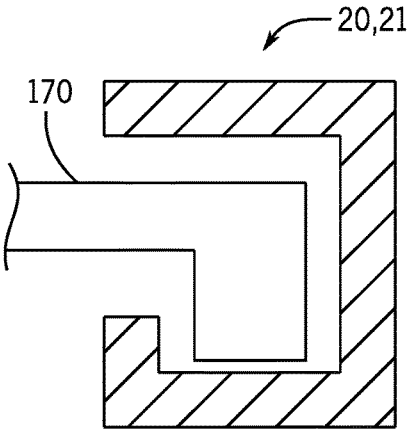
FIG. 7 is a partial schematic view of an embodiment of the first translational portion and/or the second translational portion.

FIGS. 6-7 illustrate the position of the wheels 102 disposed in the first and/or second translational portions 20, 21. FIG. 6 is a partial schematic view of an embodiment of the first translational portion 20, and/or the second translational portion 21. The first and the second translational portions 20, 21 may be cylindrical, square, rectangular, or any other polygonal shape. The first rail portion 20 and the second rail portion 21 include a first rail segment 106 and a second rail segment 110 disposed within the turbine housing 18. The first rail portion 106 and the second rail portion 110 include a first and second mating rail segment 112, 114 coupled to the turbine dolly 82. The rail segments (e.g., the first rail segment 106 and the second rail segment 110) and the mating rail segments (e.g., the first mating rail 112 and the second mating rail 114) may be coupled together by a plurality of removable couplings 156 (see FIG. 4). The plurality of removable couplings may include clamps, rods, receptacles, welds (e.g., welded flanges), threaded fasteners, or any combination thereof. As described above, the first translational portion 20 includes the first rail portion 106 disposed between the first translational portion 20 and the turbine support 22. One or more first wheels 102 are disposed along the first rail portion 106. The plurality of wheels 102 may include one or more pluralities of wheels. The plurality of wheels may include one or more vertical wheels and one or more horizontal wheels to improve stability of the turbine support along the rail portions (e.g., the rail segments 106, 110 and the mating rail segments 112, 114). In some embodiments, the translational rail portions 20, 21 may include lock assemblies 142 to selectively retract or extend into the rails. The control system 90 may be communicatively coupled to the lock assemblies 142 to control actuation of the lock assemblies via a drive 78, 84. The plurality of wheels 102 may include a plurality of retraining supports 192 mounted to the plurality of wheels 102. The plurality of retraining supports may be mounted to a first side 155 and/or a second side 157 of the rail segments 106, 110 and the mating rail segments 112, 114.

FIG. 7 is a partial schematic view of an embodiment of the first translational portion 20 and/or the second translational portion 21. As described above, the first translational portion 20 includes a first rail portion 106 disposed between the first translational portion 20 and the turbine support 22. The first and second rail segments 106, 110 and their respective mating rail segments 112, 114 may be coupled together by the plurality of removable couplings 156. In the illustrated embodiment, a secondary set of rails 170 may be disposed within the translational portions 20, 21 (e.g., the first and the second rail segment 106, 110) and may be moved within the translational portions 20, 21. The secondary set of rails 170 may be coupled to the turbine support 22, so that the turbine support 22 is translated along the translations portions 20, 21 by the secondary set of rails 170. In some embodiments, the translational portions 20, 21 and the secondary set of rails 170 may include a lubricant fitting (e.g., a grease fitting) to provide lubricant (e.g., grease) for the components that are translated.

Figure 8:
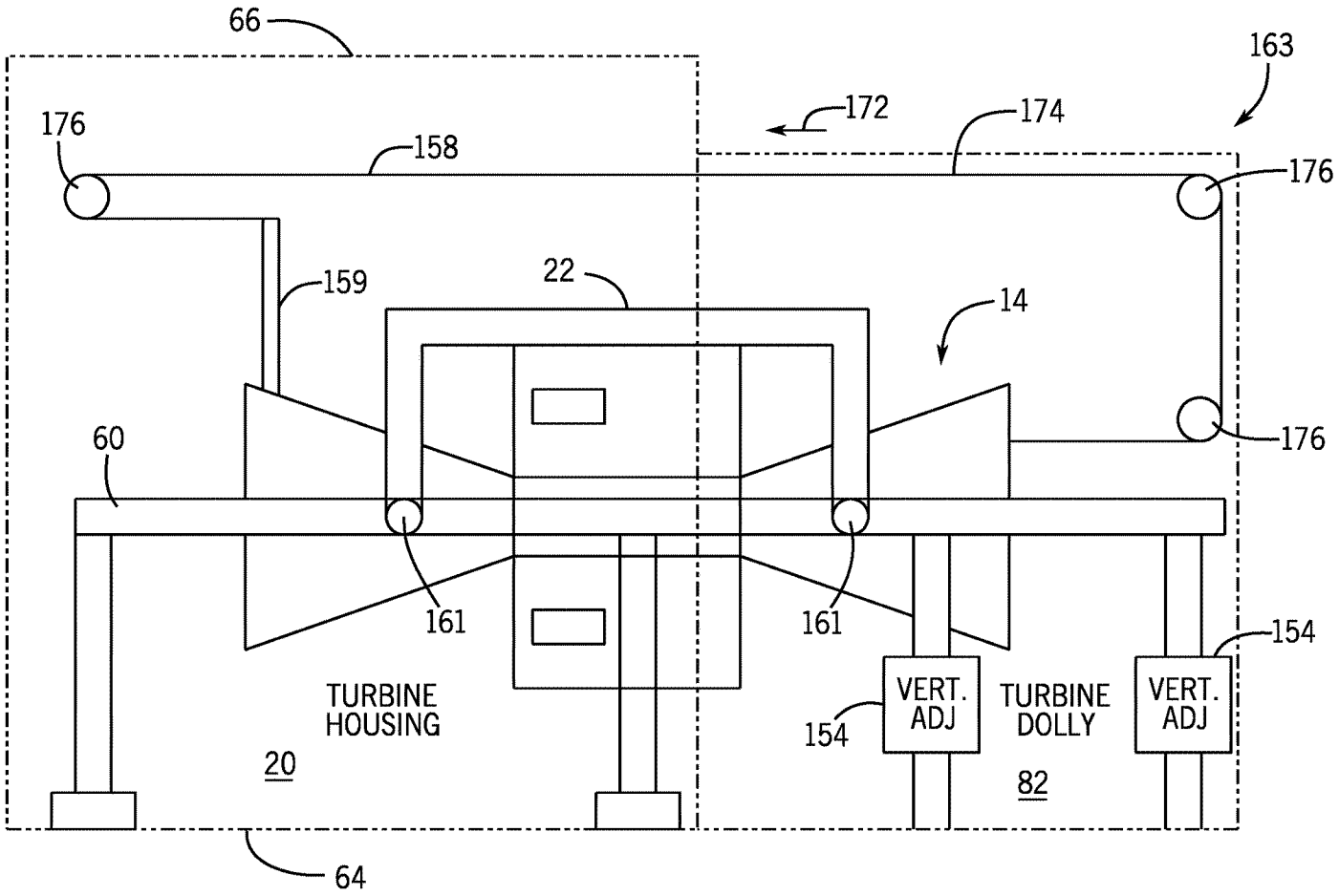
FIG. 8 is a side view of an embodiment the turbine moving machine, illustrating the turbine being moved along the first translational portion by a drive assembly, where the drive assembly includes a drive coupled to a transmission.

FIG. 8 is a side view of an embodiment of the turbine 14 being moved along the first translational portion 20 by a drive system 76, where the drive system includes the drive 78 coupled to the transmission 80. In the illustrated embodiment, the drive system 76 drives the movement of the turbine 14 along the longitudinal axis of the turbine housing 18. The transmission 80 may include a chain 174, a cable, a winch, a pulley 176, a threaded shaft, a gear assembly, a rack and pinion assembly, or any combination thereof. In the illustrated embodiment, the turbine 14 is moved along the translational portions 20, 21 using a cable and pulley system 163. As the turbine 14 is moved along the translational portions 20, 21 from the first turbine position 116 to the second turbine position 118 (e.g., adjacent the access panel), the chain is moved in a direction opposite the turbine 14, indicated by arrow 172, to facilitate movement towards the turbine dolly 82. When the turbine 14 is moved along the translational portions 20, 21 from the second turbine position 118 to the first turbine position 116, the chain is moved in the direction 24 along the longitudinal axis of the turbine housing 18 so that the turbine 14 is moved in the opposite direction back to the first turbine position 116. The chain may be supported by one or more brackets 159 to secure the chain into place. The turbine housing 18 may include braces 161 along the sides of the housing to help contain and guide the turbine 14 while moving along the translational portions. The turbine support 22, which supports the turbine 14, may be pulled toward the turbine dolly 82 with cables 158 attached to the turbine housing 18. The cables 158 may extend from winches positioned adjacent the turbine housing 18 and configured to reel in the cables 158 when turned, either manually or by one or more motors. In some embodiments, the turbine 14 may be moved along the rails using a puller system and/or rollers.

Figure 9:
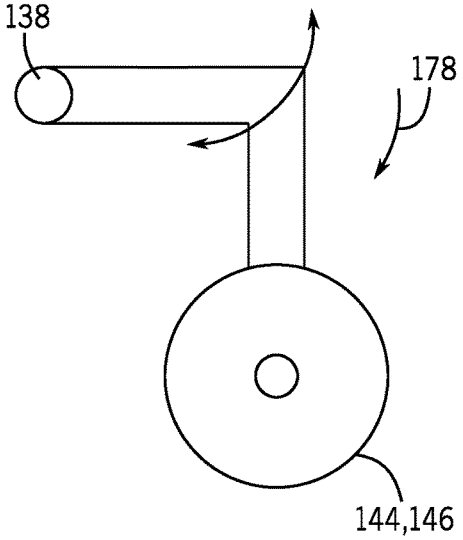
FIG. 9 illustrates a wheel of a plurality of wheel sets disposed on a turbine dolly and/or an auxiliary skid moved along the ground rail assembly.

FIG. 9 illustrates an embodiment of the plurality of wheel sets 132 disposed on the turbine dolly 82 and/or the auxiliary skid 30. As described above, each of the wheels sets 132 are disposed along a rotating shaft 138 and may be configured to move when the wheel sets 132 are activated. For example, the first plurality of wheels 144 may be utilized to move the turbine dolly 82 in the direction 24 of the longitudinal axis of the turbine housing 18 along the first pair of dolly ground rails 126. When the first plurality of wheels 144 is being utilized to move the turbine dolly 82 in the longitudinal direction 24 (see FIG. 1), the second plurality of wheels 146 is disengaged. When the first plurality of wheels 144 is being utilized, the rotating shaft 138 is rotated downward in a direction 178 to engage the first plurality of wheels 146 on the first pair of dolly ground rails 126. When the turbine dolly 82 is moved in the second direction 26 that is substantially perpendicular to the first longitudinal direction (e.g., via the second pair of dolly rails 130), the first plurality of wheels 144 is disengaged. To disengage the first plurality of wheels 144, the first plurality of wheels 144 is rotated upward in a direction opposite the direction 178 about the rotating shaft 138. After the first plurality of wheels 144 is disengaged, the second plurality of wheels 146 is engaged (e.g., when the second plurality of wheels 144 are rotated in a downward direction 178 about the rotating shaft 138 to position the second plurality of wheels 146 on the second pair of dolly rails 130).

Figure 10:
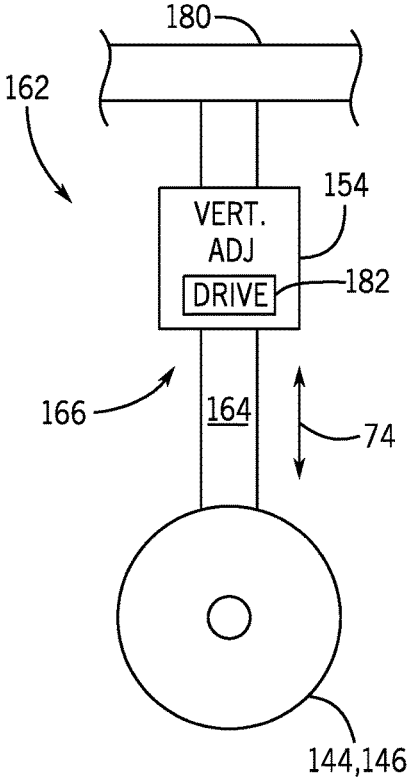
FIG. 10 illustrates a vertical adjustment assembly coupled to the turbine dolly which includes a lift portion that is driven by a drive to cause vertical movement of the lift portion.

FIG. 10 illustrates an embodiment of the vertical adjustment assembly 154 that includes the lift portion 162 that is driven a drive 182 to cause vertical movement of the lift portion 162. The lift portion 162 may be coupled to the turbine dolly 82 via the plurality of removable couplings, which may include threaded fasteners (e.g., threaded receptacles, bolts, nuts, etc.), clamps, rods, receptacles, welds, or any combination thereof. The lift portion 162 may include a retractable joint 164 that moves in the vertical direction 74. The retractable joint 164 may be coupled to the lift portion 162 at a first end by welding, brazing, a flange with connecting members, or any other suitable process. The vertical adjustment assembly 154 may include a variety lifting assemblies, such as an electrical chain hoist, an electrical wire rope hoist, a hydraulic winch, or other suitable lifting mechanism to lift and/or lower the lift portion. For example, the vertical adjustment assembly 154 may include one or more system rails 180 coupled to a lift assembly drive 182 via a coupling. The support rails 180 may be made of metal, fabric, plastic, etc. The support rails 180 provide support as the vertical adjustment assembly 154 is moved. For example, the support rails 180 may be aligned with the mating rails 112, 114 of the turbine dolly 82. The support rails 180 provide additional support to the mating rails 112, 114 of the turbine dolly 82 and the first and second rail portions 106, 110. Once the turbine 14 is removed from the housing to the turbine dolly 82, the extension rails 180 may be lowered to a desired height when the turbine 14 is out of the turbine housing 18 to maintain a desired center of gravity.

Figure 11:
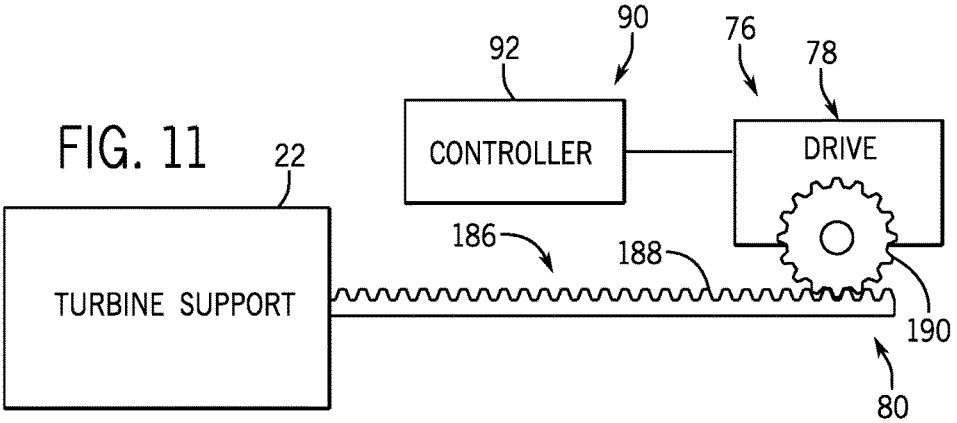
FIG. 11 is a diagram of an embodiment of the first and/or second translational portion and the drive system having the drive coupled to a rack and pinion assembly.
Figure 12:
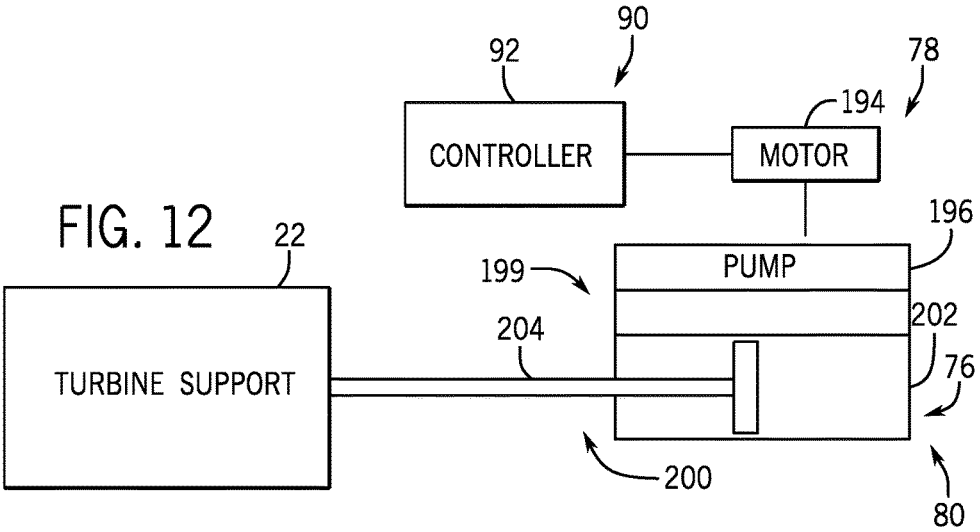
FIG. 12 is a diagram of an embodiment of the first and/or second translational portion and the drive system having a fluid drive with a motor, a pump, and a fluid driven assembly driven by fluid from the pump.
Figure 13:
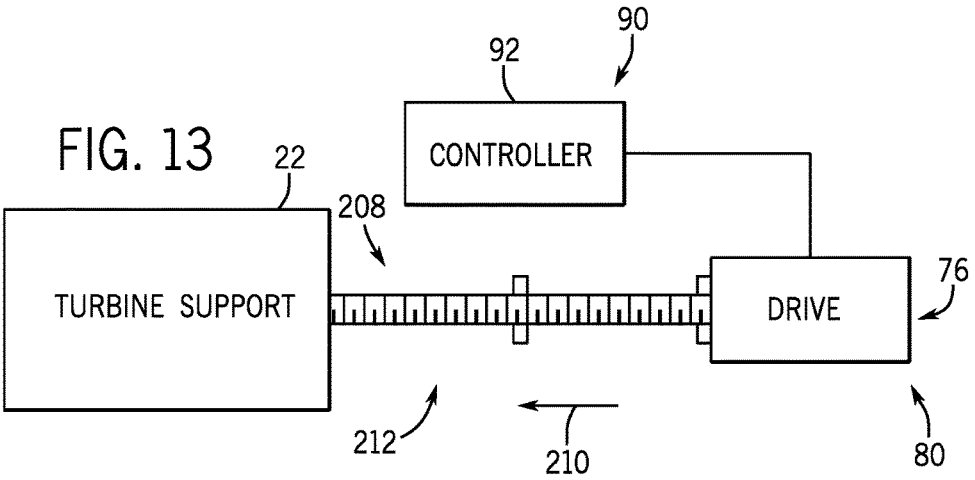
FIG. 13 is a diagram of an embodiment of the first and/or second translational portion and the drive system having the drive coupled to a rotary screw or threaded shaft of the transmission.

FIGS. 11-13 are diagrams of embodiments of the turbine support 22, the drive system 76, and the transmission 80, as illustrated in FIGS. 1-5. Though the discuss below describes the drive system 76 in relation to the turbine moving machine 12, it will be appreciated that the drive systems described herein may be similarly utilized by the dolly drive system 84, or vertical lift assembly 182, or other drive systems. FIG. 11 is a diagram of an embodiment of the first and/or second translational portions 20, 21 and the drive system 76 having the drive 78 coupled to a rack and pinion assembly 186. In the illustrated embodiment, the rack and pinion assembly 186 includes a linear gear or rack 188 and a circular gear or pinion 190 coupled to the drive 78 of the drive system 76. In operation, the drive 78 is configured to rotate the pinion 190, which in turn causes movement of the rack 188 in opposite first and second directions depending on the direction of rotation. The rack 188 is coupled to the turbine support 22, and thus movement of the rack 188 causes movement of the turbine support in the directions 24, 26.

FIG. 12 is a diagram of an embodiment of the first and/or second translational portions 20, 21 and the drive system 76 having a fluid drive 78 with a motor (e.g., an electric motor) 194 and a pump 196 driven by the motor 194, and the transmission 80 having a fluid driven assembly 198 driven by fluid from the pump. In the illustrated embodiment, the fluid driven assembly 198 includes a piston-cylinder assembly 199 fluidly coupled to the pump 196. The piston-cylinder assembly 199 includes a piston 200 disposed in a cylinder 202, wherein the piston 200 is further coupled to a shaft 204. In operation, the controller 92 may control the motor 194 to drive the pump 196, which in turn pumps a fluid (e.g., liquid or gas) into the cylinder 202 of the piston-cylinder assembly 198. The fluid then drives the piston 200 to move in one of the directions, thereby driving the turbine support 22 in one of the directions 24, 26. For example, fluid pumped into the right hand side of the cylinder causes the piston 200, the shaft 204, and the turbine support 22 to move in the direction opposite the longitudinal direction 24. Alternatively, fluid pumped into the left hand side of the cylinder causes the piston 200, the shaft 204, and the turbine support 22 to move in the longitudinal direction 24. The controller 92 may be configured to vary the speed of the motor 194 and pump 196, thereby varying the speed of movement of the piston and the turbine support 22. For example, the controller 92 may operate the fluid drive at a first speed during a first stage of movement, a second speed during a second stage of movement, and a third speed during a third stage of movement, wherein the first, second, and third speeds are progressively greater or lesser than one another.

FIG. 13 is a diagram of an embodiment of the first and/or second translational portions 20, 21 and the drive system 76 having the drive 78 coupled to a rotary screw or threaded shaft 208 of the transmission. In the illustrated embodiment, the shaft 208 may be threaded into mating threads (e.g., threaded receptacle) in the turbine support 22, such that rotation of the shaft 208 causes axial movement 210 of the turbine support 22 in one of the directions 24, 26. The drive 78 may include an electric motor, a fluid drive, or any combination thereof, configured to rotate the shaft 208. In certain embodiments, the transmission may include a worm and worm gear assembly 212. The drive system 76 also may include a plurality of bearings disposed about the threaded shaft 208, e.g., in non-threaded portions of the shaft.

Technical effects of the invention include a turbine moving machine 12 including a turbine support 22 configured to couple to the turbine 14. The turbine 14 may be moved along first and second translational portions 20, 21 (e.g., rails disposed within the turbine housing 18), while remaining coupled to the turbine support 22. The turbine 14 may be moved along the translation portions 20, 21 to move the turbine 14 from within the housing 20 and to the dolly 82. The turbine moving machine 12 may utilize various mechanical support components (e.g., drives systems, vertical lift assemblies) and one or more controllers 92 to move the turbine 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a turbine housing comprising opposite walls, a floor, a ceiling, a first end wall, and a second end wall opposite the first end wall, wherein the first end wall comprises an access panel configured to selectively open an access opening to enable installation or removal of a turbine along a longitudinal axis of the turbine;

a turbine mount disposed in the turbine housing;

a turbine moving machine disposed at least partially within the turbine housing, wherein the turbine moving machine comprises:

a turbine support configured to couple to the turbine; and a first translational portion coupled to the turbine support, wherein the turbine moving machine is configured to move the turbine lengthwise along the longitudinal axis of the turbine on the first translational portion through the access opening between a first turbine position within the turbine housing and a second turbine position outside of the turbine housing; and a vertical adjustment assembly configured to raise and lower the turbine.

2. The system of claim 1, wherein the access panel is coupled to the turbine housing with a rotational joint.

3. The system of claim 2, comprising an auxiliary skid configured to support one or more turbine support components, wherein the auxiliary skid is configured to move between a first skid position adjacent the first end wall and a second position at an offset distance away from the first end wall.

4. The system of claim 3, wherein the auxiliary skid is selectively movable along a ground rail assembly.

5. The system of claim 4, wherein the ground rail assembly comprises a first pair of ground rails and a second pair of ground rails, and the first and second pair of ground rails extend crosswise relative to one another.

6. The system of claim 5, wherein the auxiliary skid comprises a first plurality of wheels and a second plurality of wheels, the first plurality of wheels is configured to selectively engage the first pair of ground rails, the second plurality of wheels is configured to selectively engage the second pair of ground rails, and the first plurality of wheels is oriented crosswise to the second plurality of wheels.

7. The system of claim 2, comprising a turbine dolly configured to support the turbine after receiving the turbine through the access opening, wherein the turbine dolly comprises a vertical adjustment assembly configured to raise and lower the turbine and a ground rail assembly supporting the turbine dolly.

8. The system of claim 7, wherein the ground rail assembly comprises a first pair of ground rails and a second pair of ground rails, and the first and second pair of ground rails extend crosswise relative to one another.

9. The system of claim 8, wherein the turbine dolly comprises a first plurality of wheels and a second plurality of wheels, the first plurality of wheels is configured to selectively engage the first pair of ground rails, and the second plurality of wheels is configured to selectively engage the second pair of ground rails.

10. The system of claim 7, wherein the first translational portion comprises a first rail segment disposed in the turbine housing and a mating first rail segment coupled to the turbine dolly.

11. The system of claim 10, wherein the first translational portion is disposed overhead a turbine area for the turbine.

12. The system of claim 11, wherein the turbine moving machine comprises a second translational portion coupled to the turbine support, and the second translational portion comprises a second rail segment disposed in the turbine housing and a mating second rail segment coupled to the turbine dolly, wherein the first and second translational portions are disposed on opposite sides of the turbine area for the turbine.

13. The system of claim 1, wherein the turbine support comprises a turbine support frame, a spreader bar, one or more lift supports, or a combination thereof.

14. The system of claim 1, wherein the first translational portion comprises a first rail portion that interlocks and slides axially along a second rail portion between the first translational portion and the turbine support.

15. The system of claim 1, wherein the first translational portion comprises one or more first wheels disposed along a first rail portion between the first translational portion and the turbine support.

16. The system of claim 15, wherein the turbine moving machine comprises a second translational portion coupled to the turbine support, and the second translational portion comprises one or more second wheels disposed along a second rail portion between the second translational portion and the turbine support.

17. The system of claim 1, comprising a drive assembly having a drive coupled to a transmission, wherein the drive assembly is configured to drive movement of the turbine lengthwise along the first translational portion.

18. The system of claim 17, wherein the transmission comprises a chain, a cable, a winch, a pulley, a threaded shaft, a gear assembly, a rack and pinion assembly, or any combination thereof.

19. A system, comprising:

a turbine housing comprising opposite walls, a floor, a ceiling, a first end wall, and a second end wall opposite the first end wall, wherein the first end wall comprises an access panel configured to selectively open an access opening to enable installation or removal of a turbine along a longitudinal axis of the turbine;

a turbine mount disposed in the turbine housing;

a ground rail assembly; and an auxiliary skid configured to support one or more turbine support components, wherein the auxiliary skid is configured to move along the ground rail assembly between a first skid position adjacent the first end wall and a second position at an offset distance away from the first end wall.

20. A method, comprising:

supporting a turbine with a turbine support of a turbine moving machine disposed at least partially within a turbine housing, wherein the turbine comprises a longitudinal axis, wherein the turbine housing comprises opposite walls, a floor, a ceiling, a first end wall, and a second end wall opposite the first end wall, wherein the first end wall comprises an access panel configured to selectively open an access opening to enable installation or removal of the turbine along the longitudinal axis of the turbine; and moving the turbine lengthwise axially along the longitudinal axis on a first translational portion of the turbine moving machine through the access opening between a first turbine position within the turbine housing and a second turbine position outside of the turbine housing.

21. A system, comprising:

a turbine housing;

a turbine mount disposed in the turbine housing;

a turbine moving machine disposed at least partially within the turbine housing, wherein the turbine moving machine comprises:

a turbine support configured to couple to a turbine; and first and second translational portions coupled to the turbine support, wherein the first translational portion comprises one or more first wheels disposed along a first rail portion between the first translational portion and the turbine support, the second translational portion comprises one or more second wheels disposed along a second rail portion between the second translational portion and the turbine support, and the turbine moving machine is configured to move the turbine lengthwise along a longitudinal axis of the turbine on the first translational portion between a first turbine position within the turbine housing and a second turbine position outside of the turbine housing; and a vertical adjustment assembly configured to raise and lower the turbine.

22. A system, comprising:

a turbine housing;

a turbine mount disposed in the turbine housing;

a turbine moving machine disposed at least partially within the turbine housing, wherein the turbine moving machine comprises:

a turbine support configured to couple to a turbine; and a first translational portion coupled to the turbine support, wherein the turbine moving machine is configured to move the turbine lengthwise along a longitudinal axis of the turbine on the first translational portion between a first turbine position within the turbine housing and a second turbine position outside of the turbine housing;

a drive assembly having a drive coupled to a transmission, wherein the drive assembly is configured to drive movement of the turbine lengthwise along the first translational portion, wherein the transmission comprises a chain, a cable, a winch, a pulley, a threaded shaft, a gear assembly, a rack and pinion assembly, or any combination thereof; and a vertical adjustment assembly configured to raise and lower the turbine.

* * * * *